US006375376B1

(12) United States Patent
Hsu

(10) Patent No.: US 6,375,376 B1
(45) Date of Patent: Apr. 23, 2002

(54) PHOTO FRAME PEN

(76) Inventor: Jeou-En Hsu, 5F, No. 14, Alley 8, Lane 45, Pao-Hsing Rd., Hsin-Tien City, Taipei Hsien (TW)

( * ) Notice: Subject to any disclaimer, the term of this patent is extended or adjusted under 35 U.S.C. 154(b) by 0 days.

(21) Appl. No.: 09/711,307

(22) Filed: Nov. 14, 2000

(51) Int. Cl.[7] ..... B43K 23/12
(52) U.S. Cl. ..... 401/247; 401/195; 401/243
(58) Field of Search ..... 401/195, 243, 401/246, 247, 52, 192

(56) References Cited

U.S. PATENT DOCUMENTS 4,381,615 A * 5/1983 Lonsmin ..... 401/195
6,129,470 A * 10/2000 Fang ..... 401/195
6,257,789 B1 * 7/2001 Podszuwelt et al. ..... 401/192

* cited by examiner

*Primary Examiner*—David Walczak
(74) *Attorney, Agent, or Firm*—Rosenberg, Klein & Lee

(57) ABSTRACT

A display frame pen which functions both as a pen and a frame structure for displaying such things as photographs. The display frame pen includes a pen cap assembly detachably coupled to a pen casing assembly. The pen cap assembly includes telescopically coupled inner and outer barrels and a clip cap coupled to the outer barrel. The outer barrel is formed with a sidewall portion through which a view window having any of numerous predetermined shapes is formed. The inner barrel is received in displaceable manner within an inner compartment encircled by the outer barrel's sidewall portion, such that it is displaceable relative to the outer barrel between retracted and extended positions. Preferably, the inner barrel is also angularly displaceable relative to the outer barrel. When in its retracted position, an intermediate portion of the inner barrel is at least partially visible through the outer barrel's view window. By attaching a photograph or other indicia to the outer wall of the inner barrel's intermediate portion, then, a user may freely arrange the barrels of the pen cap assembly such that the photograph or indicia is visible through the outer barrel's view window.

11 Claims, 6 Drawing Sheets

PHOTO FRAME PEN

BACKGROUND OF THE INVENTION

1. Field of the Invention

The invention relates to a photo frame pen, and in particular, to a pen in which a picture applied thereon can be selectively displayed as desired, its cap being readily reconfigurable toward that end.

2. Description of the Prior Art

Traditionally, a pen is used exclusively to write, and is without any other additional practical function. However, it is one of the instruments most frequently carried on the person.

In a prior patent document entitled "An Interesting Pen," (application Ser. No. 85203842) file on Mar. 14, 1996 by the inventor herein, a pen having a rotatable pen cap which exhibits a kaleidoscope is disclosed. The resulting effect is beautiful yet incomplete in that the given pattern must be finished during the production of the pen to be fixed for each pen.

This and other disadvantages in prior art amusement pens are overcome by a photo frame pen formed in accordance with he present invention.

SUMMARY OF THE INVENTION

Accordingly, one object of the invention is to provide a photo frame pen in which a cap assembly having outer and inner pen cap barrels simply yet effectively enables amusing reconfiguration of a writing instrument.

Another object of the invention is to provide a photo frame pen, wherein an engaging mechanism between inner and outer barrels enables the inner barrel to be drawn out of the outer barrel such that an aesthetically pleasing picture or photograph can be applied to an outer wall of the inner barrel for user selective display thereafter.

A photo frame pen which attains the above-mentioned objects comprises at least a pen cap assembly that includes a clip cap, an inner barrel, and an outer barrel, wherein the clip cap is connected to the outer barrel via notched engagement or by means of a connecting part. A transparent window of a desired pattern is provided on a sidewall portion of the outer barrel, and an inner annular engaging slot is provided at an upper end portion of the outer barrel. The inner barrel has a slightly enlarged upper edge formed on its top end portion so that it can be snap fastened to the annular engaging slot of the outer barrel. The inner barrel is disposed to move up and down within the outer barrel, and the bottom end portion of the inner barrel is provided with a snap-fastening ring recess to engage a protruding ring formed about a front end portion of the pen casing assembly.

BRIEF DESCRIPTION OF THE DRAWINGS

The drawing disclose illustrative embodiments of the present invention which serve to exemplify the various advantage and objects thereof, and are as follows.

DETAILED DESCRIPTION OF THE PREFERRED EMBODIMENTS

Referring to FIGS. 1–7, the reference numbers correspond to their respective elements as follows:

| Reference No. | Element |
|---|---|
| 10 | Pen cap assembly |
| 11 | Clip cap |
| 111 | Clip |
| 112 | Protuberance |
| 12 | Outer barrel |
| 121 | Notch |
| 122 | Wall surface |
| 123 | Transparent view window |
| 124 | Annular engaging slot |
| 125 | Stopping ring |
| 13 | Inner barrel |
| 131 | Upper edge |
| 132 | Braking part |
| 133 | Snap-fastening ring |
| 134 | Stopping ring |
| 20 | Pen casing assembly |
| 21 | Protruding ring |
| 30 | Outer barrel |
| 31 | Metal wall surface |
| 32 | Hole |
| 40 | Pivotal connecting button |
| 50 | Outer barrel |
| 51 | Stopping point |
| 60 | Inner barrel |
| 61 | Upper section |
| 62 | Lower edge |
| 63 | Slot |
| 64 | Lower section |
| 65 | Snap-fastening flange |
| 66 | Lower edge |
| 661 | Snap fastening site |
| 67 | Braking part |
| 68 | Wall surface |
| 69 | Stopping part |
| 80 | Pen |
| 81 | Protruding ring |

Figure 1:
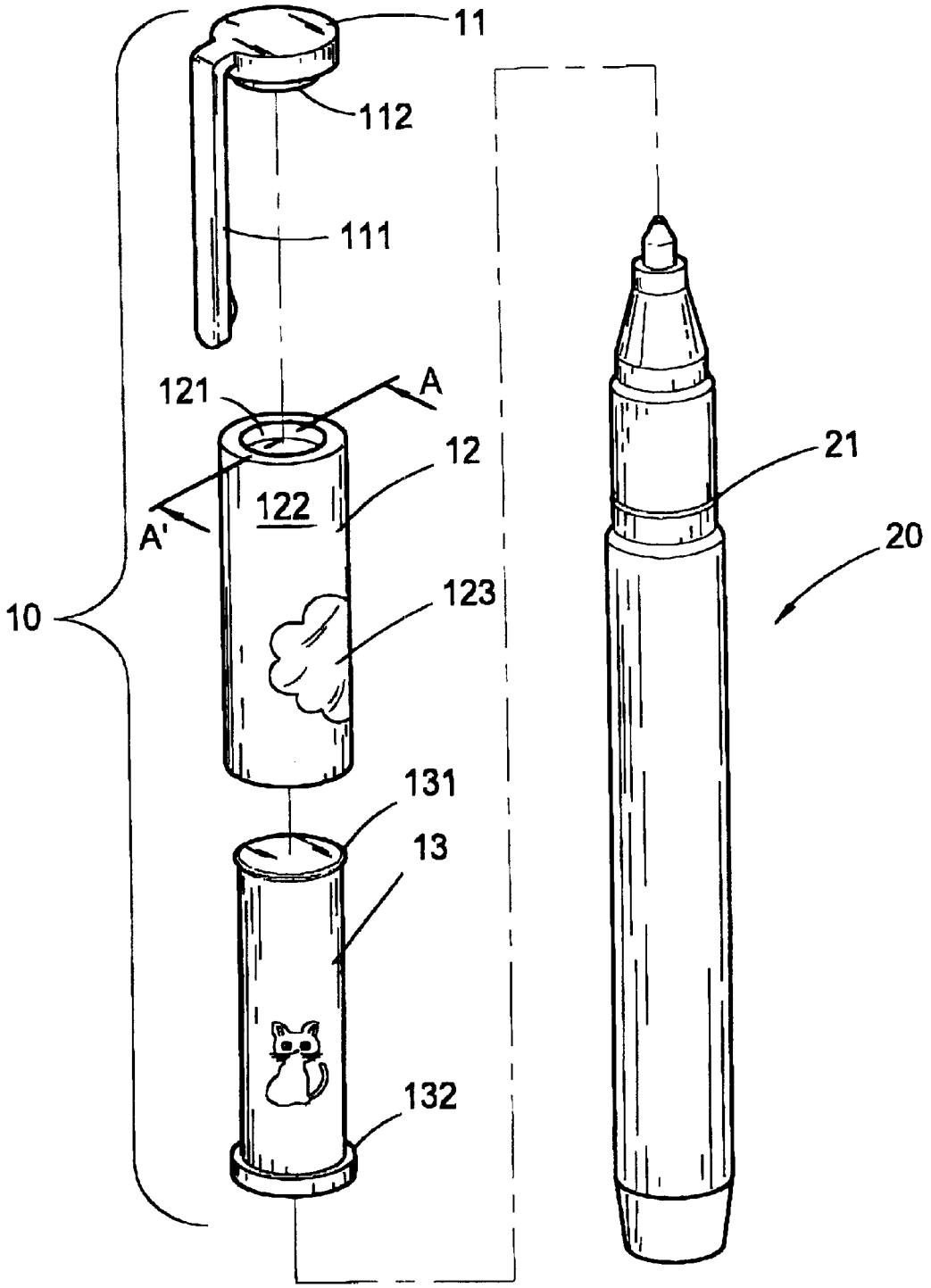
FIG. 1 is an exploded perspective view of one embodiment of the photo frame pen according to the invention.

Referring to FIG. 1, the photo frame pen provided by the invention comprises a pen cap assembly 10 and a pen casing assembly 20, wherein the pen cap assembly 10 includes a clip cap 11, an outer barrel 12, and an inner barrel 13. The clip cap 11 has a protuberance 112 provided on the lower part of its attachment portion and a clip portion 111 extending from a side of the attachment portion. On an upper part of the outer barrel 12 is provided a notch 121 for engaging the protuberance 112 on the lower part of the clip cap 11, and, on its sidewall surface 112 is provided a transparent view window 123 that can be designed as desired in various shapes such as, for example, a heart, a flower, and the like. The outer barrel 12 defines an inner compartment, and an annular engaging slot 124 is formed internally into its sidewall near the upper inside end (referring to FIG. 2), and a stopping ring 125 is provided to protrude from the sidewall near its lower end. The inner barrel 13 is shorter than the outer barrel 12 such that the inner barrel 13 may almost completely insert into the outer barrel 12. The inner barrel 13 is formed with a slightly enlarged upper edge 131 on its upper portion which snap fits into the annular engaging slot 124 of the outer barrel 12 to engage the barrels with each other. A braking part 132 is provided at a bottom end of the inner barrel 13 to limit the up and down movement of the inner barrel 13 inside the outer barrel 12; and, a stopping ring 134 is provided inside the upper outer periphery of the inner barrel 12 (referring to FIG. 2) to engage the outer barrel's stopping ring 125 and thereby prevent it from dropping out of the outer barrel altogether.

About a front end portion of the pen casing assembly 20, a protruding ring 21 is provided for engaging with a snap-fastening ring recess 133 formed into a lower periphery of the inner barrel 13 for supporting against dislodging.

Figure 2:
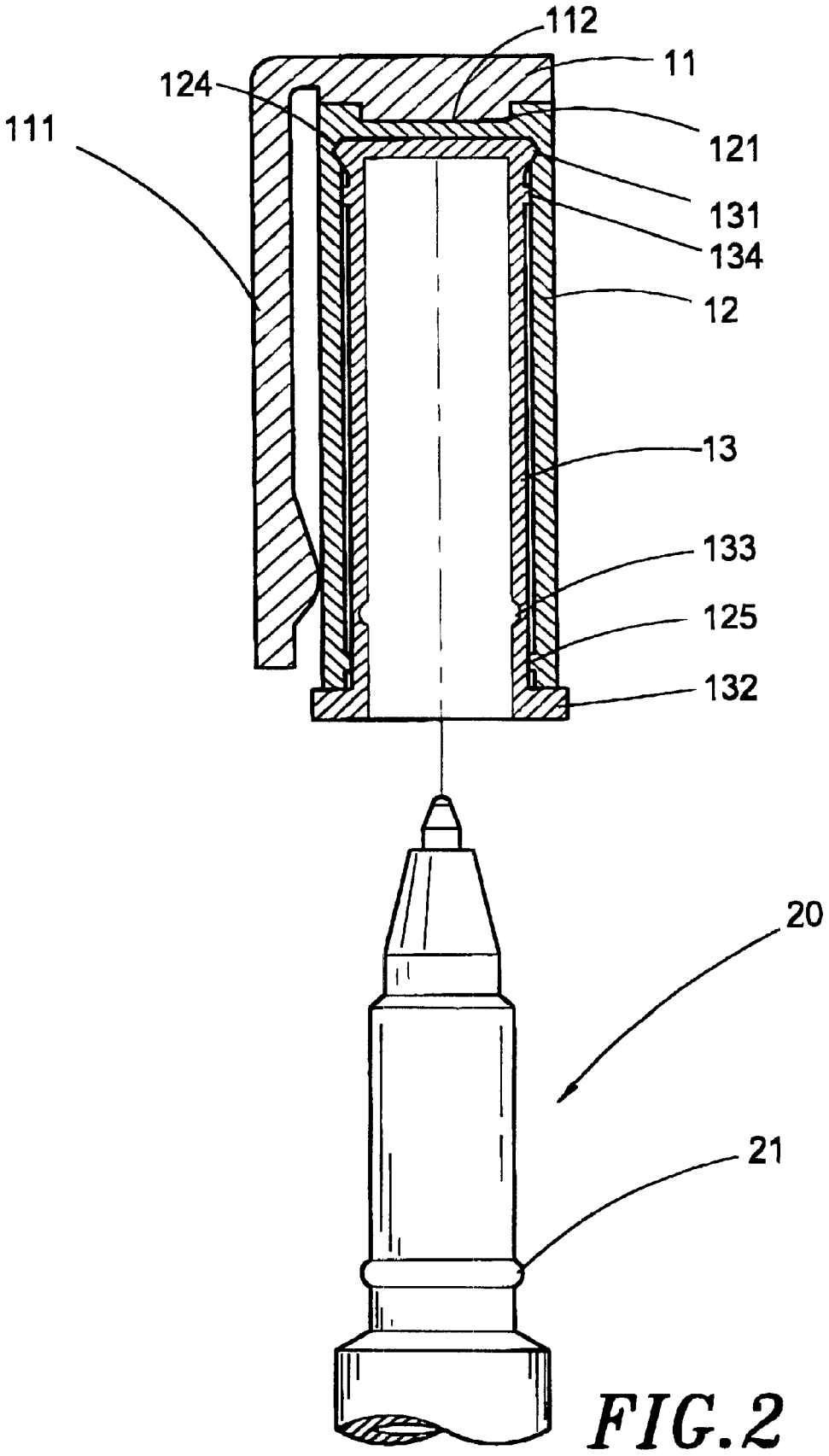
FIG. 2 is a sectional view of a pen cap assembly of the photo frame pen shown in FIG. 1 taken along line A—A'.
Figure 3:
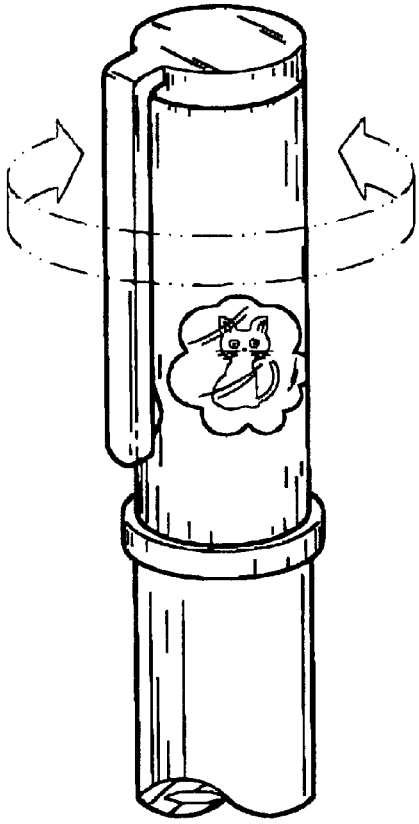
FIG. 3 is a perspective view illustrating the reconfigurability of the photo frame pen of FIG. 1.

Referring to FIG. 2, after the pen cap and casing assemblies are fully coupled together, the user can apply a force on the braking part 132 to draw the inner barrel 13 out to its extended position relative to the outer barrel 12. By virtue of the stopping engagement of the stopping ring 134 of the inner barrel 13 and the stopping ring 125 of the outer barrel 12, the inner barrel 13 can be maintained within the outer barrel 12, without dropping out. It can thereafter be moved up then down within the outer barrel 12. After drawing the inner barrel 13 partially out of the outer barrel 12, a picture can be applied on its outer wall surface such that when pushed back upward into the outer barrel, the user can see the picture through the transparent view window of the outer barrel. A photo frame pen with a rotatably configurable display frame is thus realized, as shown in FIG. 3.

Figure 4:
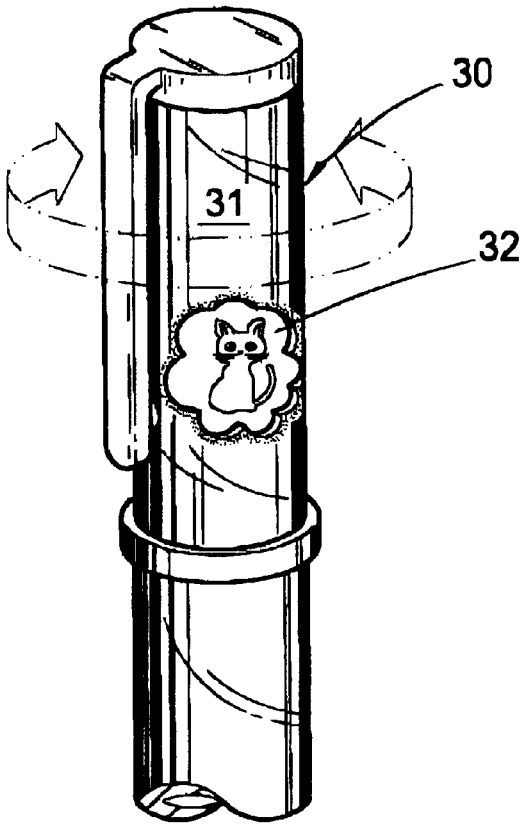
FIG. 4 is a perspective view illustrating the reconfigurability of another embodiment of the photo frame pen according to the invention.

In addition to transparent plastics, the pen cap assembly barrels can be made from other materials such as metal and the like, as shown in FIG. 4. Here, the outer barrel 30 is made from a metal material and a hole 32 is opened on the metal sidewall 31 in such manner that the picture on the surface of the inner barrel can be viewed therethrough. By rotating the outer barrel, the picture displayed through the window formed by hole 32 may be freely changed to another applied to a different part of the inner barrel.

Figure 5:
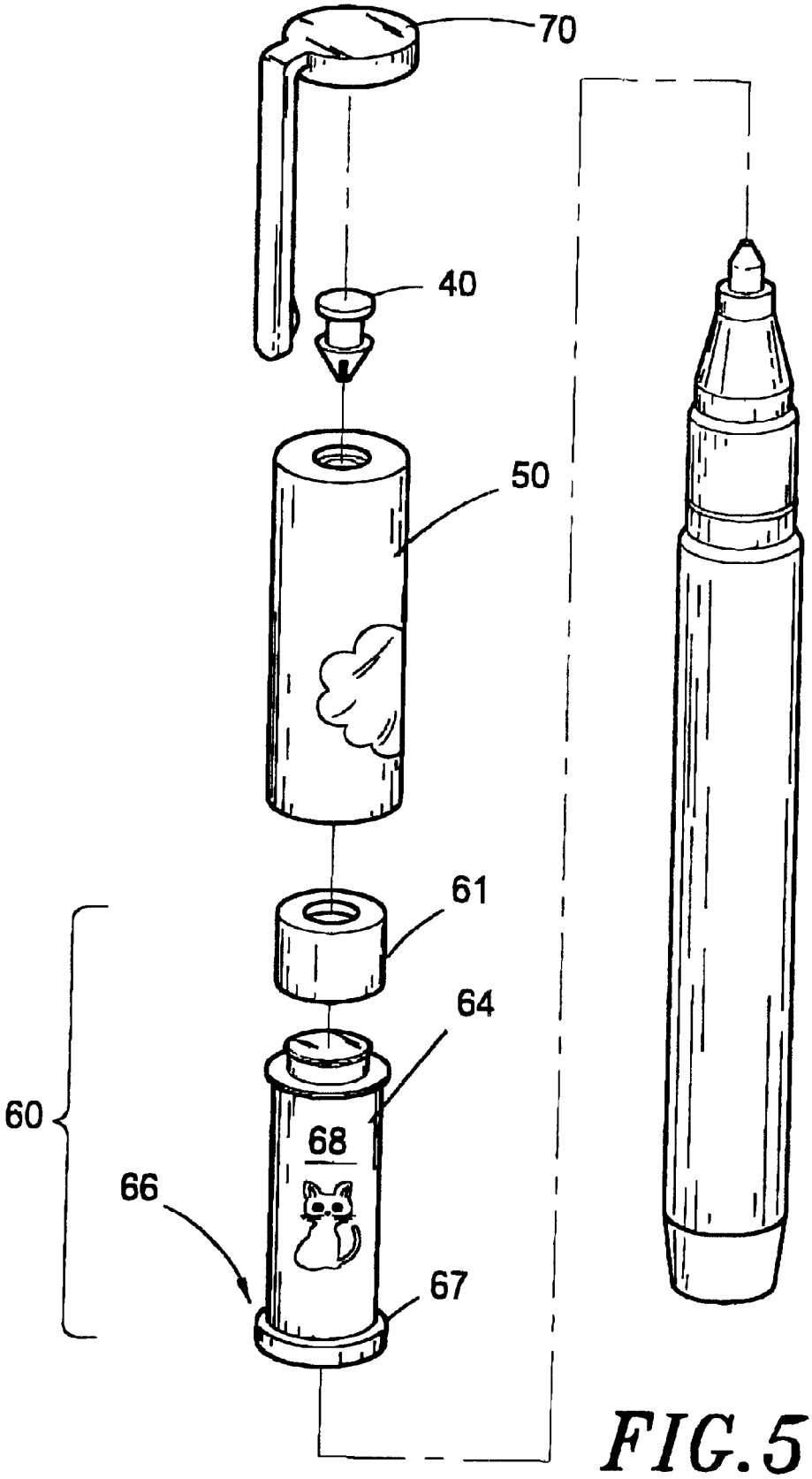
FIG. 5 is another exploded perspective view showing the structure of the photo frame pen according to another embodiment of the invention.

Referring to FIG. 5, another embodiment according to the invention is shown. In this embodiment, a pivotal connecting button 40 penetrates an outer barrel 50 and an inner barrel 60 to couple them securely with a clip cap 70 while enabling them to rotate freely relative to one another. This structure is characterized in that the inner barrel 60 is of a two-section type wherein its upper section 61 is connected with the pivotal connecting button 40 and has formed near its lower edge 62 an inner slot 63 (see FIG. 6). At the upper portion of the inner barrel's lower section 64 are formed a braking/stopping part 69 and a snap-fastening flange 65 which engages the slot 63 of the upper section. A braking part 67 is provided at the lower section's lower edge 66. By virtue of this divided-section design for the inner barrel 60, by pulling outwardly on the braking part 67, a user can draw out and access a surface for application of a picture, i.e. the surface 68 on the inner barrel.

Figure 6:
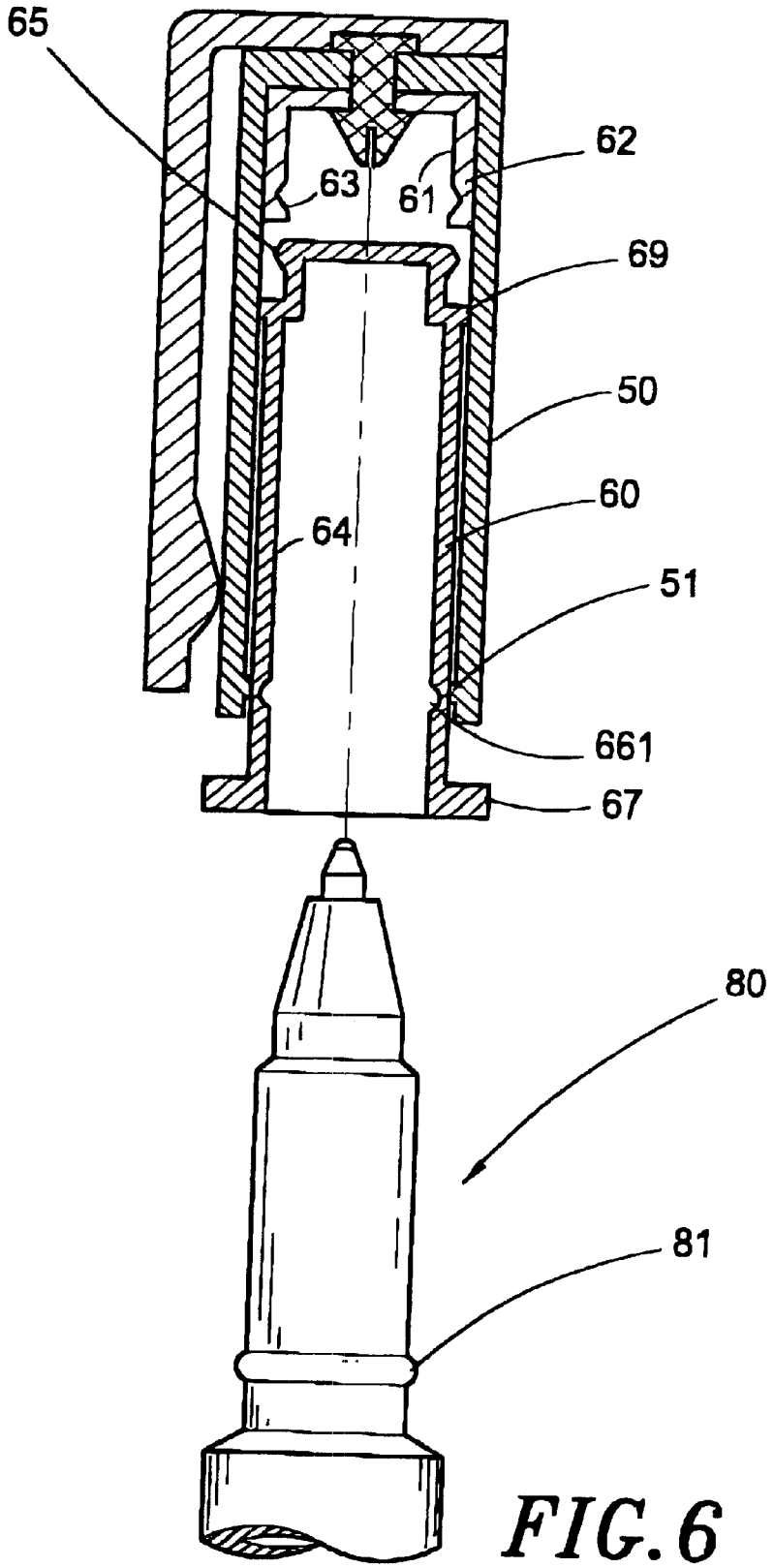
FIG. 6 is a sectional view of a pen cap assembly of the photo frame of FIG. 5; and, FIG. 7 is a perspective view illustrating the reconfigurability of the photo frame pen according to yet another embodiment of the invention.
Figure 7:
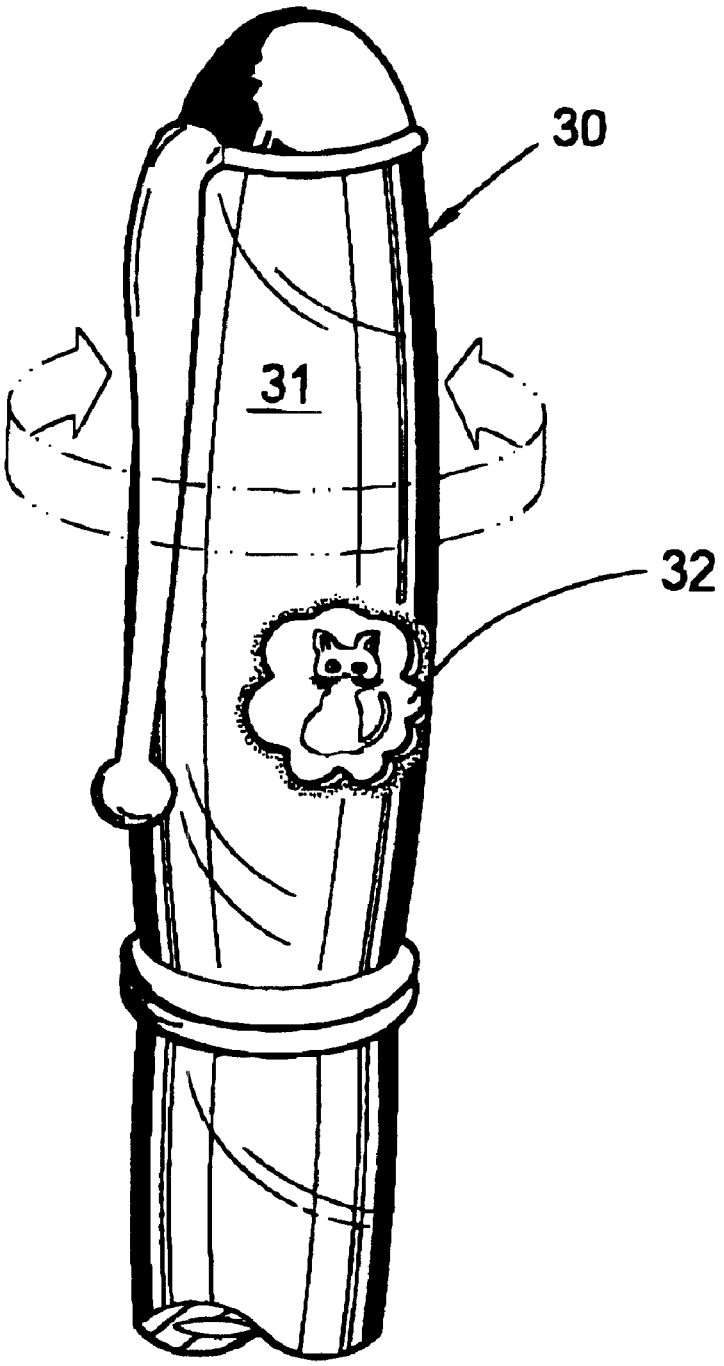

Referring to FIG. 6, as the inner barrel 60 is drawn out, the stopping part 69 of the inner barrel 60 lower section is stopped by a stopping point 51 provided at the lower end of the outer barrel 60, so that the inner barrel 60 lower section will not be drawn entirely out. On the other hand, when the inner barrel 60 lower section is pushed upwardly back to its original state, the slot 63 of the lower edge 62 of the upper section 61 of the inner barrel 60 will be engaged in snap-fastened manner by the snap-fastening flange 65 of the lower section 64 so that the inner barrel 60 will be locked in place. In the pen casing assembly 80, a protruding ring 81 is provided about the pen's front end. The protruding ring 81 can snap fasten with a snap fastening site 661 formed into the lower edge of the inner barrel and thereby provide a supporting force to prevent dislodging from the pen cap assembly.

Furthermore, the photo frame pen according to the invention provides two separable engagement structures, one between the outer barrel 50 and the inner barrel 60, and the other between the inner barrel and the pen casing assembly 80. The tightness of engagement between the pen casing assembly 80 and the inner barrel 60 must be less than that between the outer barrel 50 and the inner barrel 60. In other words, when the photo frame pen according to the invention is used to write with, the force required to separate the pen cap assembly from the pen casing assembly is not great enough to draw out the inner barrel from the outer barrel. On the other hand, by virtue of the braking part 67, the force applied by the user can be applied in isolated manner for just separating the pen cap and pen casing assemblies such that the pen casing can be drawn out readily.

The photo frame pen according to the invention has the following advantages:

1. Since a pen is frequently used to write with, a pleasant picture in the photo frame is frequently displayed to the user to amuse during writing.
2. By just drawing out the inner barrel and substituting the old picture with a new one, the photo frame pen according to the invention provides a highly flexible apparatus that a user can conveniently and repeatedly customize.
3. The material used to make the pen can be changed to produce different feel and realize particular qualities in the pen.

Many changes and modifications in the above described embodiments of the invention can, of course, be carried out without departing from the invention's scope. Accordingly, to promote the progress in science and the useful arts, the invention disclosed herein is intended to be limited only by the appended claims.

What is claimed is:

1. A display frame pen comprising:

(a) a pen casing assembly having a longitudinally extended front end portion, said front end portion having a protruding ring formed thereon; and, (b) a pen cap assembly detachably coupled to said front end portion of said pen casing assembly, said pen cap assembly including:

(1) an outer barrel having upper and lower end portions and a sidewall portion extending longitudinally therebetween, said sidewall portion substantially encircling an inner compartment extending longitudinally upward from an opening defined by said lower end portion, said upper end portion including a notched part, said sidewall portion having formed therein at least one view window for visual access of said inner compartment therethrough, said sidewall portion having formed therein adjacent said upper end portion an annular engaging slot communicating with said inner compartment, said sidewall portion having an outer stopping ring formed thereon adjacent said lower end portion to protrude into said inner compartment;

(2) an inner barrel telescopically disposed within said inner compartment of said outer barrel for displacement relative thereto between retracted and extended positions, said inner barrel having top and bottom end portions and an intermediate portion extending longitudinally therebetween to be at least partially visible in said retracted position through said outer barrel view window, said intermediate portion substantially encircling an inner chamber extending longitudinally upward from an opening defined by said bottom end portion for receiving therein said front end portion of said pen casing assembly, said intermediate portion having formed therein a fastening ring recess communicating with said inner chamber for engaging said protruding ring of said pen casing assembly front end portion, said intermediate portion having an inner stopping ring protruding radially outward therefrom for retentively engaging in said extended position said outer stopping ring of said outer barrel, said top end portion having an enlarged upper edge part for lockingly engaging in said retracted position said annular engaging slot of said outer barrel, said bottom end portion having a brake portion projecting radially therefrom; and, (3) a clip cap coupled to said outer barrel, said clip cap having a protrusive attachment portion engaging said notched part of said outer barrel upper end portion and a clip portion extending therefrom.

2. The display frame pen as recited in claim 1 wherein said view window includes a transparent panel describing a predetermined contour.

3. The display frame pen as recited in claim 1 wherein said inner and outer barrels of said pen cap assembly are each substantially formed of a metallic material.

4. The display frame pen as recited in claim 3 wherein said window formed in said outer barrel of said pen cap assembly defines an open space.

5. The display frame pen as recited in claim 1 wherein said inner and outer barrels of said pen cap assembly are coupled one relative to the other in angularly displaceable manner.

6. The display frame pen as recited in claim 1 wherein said inner and outer barrels are engaged in snap fit manner, and said inner barrel and said pen casing assembly are engaged in snap fit manner, said snap fit engagement of said inner and outer barrels being greater in bias against release than said snap fit engagement of said inner barrel and said pen casing assembly.

7. A display frame pen comprising:

(a) a pen casing assembly having a longitudinally extended front end portion, said front end portion having a protruding ring formed thereon; and, (b) a pen cap assembly detachably coupled to said front end portion of said pen casing assembly, said pen cap assembly including:

(1) an outer barrel having upper and lower end portions and a sidewall portion extending longitudinally therebetween, said upper end portion having formed therein an axially extended first through hole, said sidewall portion substantially encircling an inner compartment extending longitudinally upward from an opening defined by said lower end portion, said sidewall portion having formed therein at least one view window for visual access of said inner compartment therethrough, said sidewall portion having an outer stopping ring formed thereon adjacent said lower end portion to protrude into said inner compartment;

(2) an inner barrel telescopically disposed within said inner compartment of said outer barrel for displacement relative thereto between retracted and extended positions, said inner barrel having top and bottom end portions and an intermediate portion extending longitudinally therebetween to be at least partially visible in said retracted position through said outer barrel view window, said intermediate portion substantially encircling an inner chamber extending longitudinally upward from an opening defined by said bottom end portion for receiving therein said front end portion of said pen casing assembly, said intermediate portion having formed therein a fastening ring recess communicating with said inner chamber for engaging in snap fit manner said protruding ring of said pen casing assembly front end portion, said intermediate portion having an inner stopping ring protruding radially outward therefrom for retentively engaging in said extended position said outer stopping ring of said outer barrel, said top end portion having formed therein an axially extended second through hole coaxially aligned with said first through hole of said outer barrel upper end portion, said bottom end portion having a brake portion projecting radially therefrom;

(3) a clip cap coupled to said outer barrel, said clip cap having an attachment portion and a clip portion extending axially downward therefrom; and, (4) a pivotal connecting button coupled to said attachment portion of said clip cap and retentively engaging said through holes of said outer and inner barrel upper and top end portions.

8. The display frame pen as recited in claim 7 wherein said inner barrel includes detachable upper and lower sections, said upper section including said top end portion, said lower section including said intermediate and bottom end portions.

9. The display frame pen as recited in claim 8 wherein said upper section has formed therein an annular slot, and said lower section has formed thereon a fastening flange releasably engaging in snap fit manner said annular slot of said upper section.

10. The display frame pen as recited in claim 9 wherein said snap fit engagement of said upper and lower sections of said inner barrel is greater in bias against release than said snap fit engagement of said lower section bottom end and pen casing assembly front end portions.

11. The display frame pen as recited in claim 7 wherein said inner and outer barrels of said pen cap assembly are coupled one relative to the other in angularly displaceable manner.

* * * * *